US008529316B2

(12) United States Patent
Powell et al.

(10) Patent No.: US 8,529,316 B2
(45) Date of Patent: Sep. 10, 2013

(54) SHARPENING APPARATUS FOR PLANE IRON CROWNING

(75) Inventors: David G. Powell, Wellesley, MA (US); Toshio Odate, Woodbury, CT (US)

(73) Assignee: David G. Powell, Wellesley, MA (US)

( * ) Notice: Subject to any disclaimer, the term of this patent is extended or adjusted under 35 U.S.C. 154(b) by 241 days.

(21) Appl. No.: 12/592,382

(22) Filed: Nov. 23, 2009

(65) Prior Publication Data

US 2010/0075583 A1 Mar. 25, 2010

Related U.S. Application Data

(63) Continuation of application No. 10/846,377, filed on May 13, 2004, now abandoned.

(51) Int. Cl.
*B24B 1/00* (2006.01)
*B28D 1/30* (2006.01)

(52) U.S. Cl.
USPC ..... 451/56; 451/443; 125/2

(58) Field of Classification Search
USPC ..... 451/552–559, 443, 444, 321, 319, 451/45, 905, 913; 125/2–8, 26, 27; 76/82.2
See application file for complete search history.

(56) References Cited

U.S. PATENT DOCUMENTS

| | | | | |
|---|---|---|---|---|
| 2,058,348 | A * | 10/1936 | Nichols | 451/556 |
| 4,497,355 | A * | 2/1985 | Smith | 30/167 |
| 5,520,574 | A * | 5/1996 | Wilson | 451/540 |
| 5,558,572 | A * | 9/1996 | Fletcher | 451/552 |
| 5,640,888 | A * | 6/1997 | Lee | 76/89.2 |

* cited by examiner

*Primary Examiner* — Dung Van Nguyen
(74) *Attorney, Agent, or Firm* — Iandiorio Teska & Coleman, LLP

(57) ABSTRACT

A sharpening apparatus having a slightly convexly or concavely curved abrasive surface, for use in sharpening woodworking tools or in other fields requiring such processing of precision parts or tools. The invention may further employ either cylindrical or conic abrasive surfaces. Cylindrical abrasive surfaces are desirable when a curvature of a fixed radius is desired, or where accuracy of the curvature radius is required. Conic or semi-conic surfaces may be used to enable a user, by means of short sharpening strokes, to achieve an approximate desired curvature among a range of possible curvatures provided along the length of the abrasive surface as the curvature radius progressively declines. In this way, one abrasive surface may be used to achieve a variety of curvatures.

11 Claims, 3 Drawing Sheets

SHARPENING APPARATUS FOR PLANE IRON CROWNING

RELATED APPLICATIONS

This application is a continuation of prior U.S. patent application Ser. No. 10/846,377, filed on May 13, 2004, hereby incorporated by reference herein, and to which this application claims the benefit of and priority to under 35 U.S.C. §§119, 120, 363, 365, and 37 C.F.R. §1.55 and §1.78.

FIELD OF INVENTION

The present invention relates to a sharpening apparatus, specifically, to a sharpening apparatus suited for forming and sharpening cutting tools for woodworking, such as chisels and crowned plane irons.

BACKGROUND OF THE INVENTION

The hand plane is very important to woodworkers and furniture makers because it is the best tool for creating a finished flat surface in wood. Superior results are achieved with this tool because the wood fibers are cleanly severed, not torn, which creates a smooth, continuous surface ready for finishing. This is true even where the surface comprises two or more separate boards that have been joined side-by-side to create a larger piece.

The hand plane is so effective that it remains the tool of choice for final surfacing, despite all of the modern power tool alternatives. Power planers improve a wood surface, but leave noticeable and unattractive knife marks. Power sanders can remove the knife marks, but remove the knife marks, but tear, rather than cleanly sever, the wood fibers, resulting in a rougher surface.

Although today the body of a hand plane is more often made of metal, in earlier times these bodies were made of wood and the only metal portion would have been in the part incorporating the cutting edge. That part was termed the "iron" and the terminology continues even in speaking of modern planes that are substantially all metal.

In fine woodworking, the hand plane blade, or "iron," used to impart the final surface finish is often curved or "crowned." Such crowned irons cut a shaving from a wide board of wood, leaving no noticeable ridges in the wood because the shaving produced will be thickest along its longitudinal center line and gradually taper in thickness to nothing in the lateral directions, left and right of the shaving's center line. Thus the plane will not impart to the wood any "trails," detectable by feel or appearance and the properly planed surface will be continuous and smooth so as to reveal the grain and color of the wood.

The crowned iron edge may have any of several geometries and still not leave noticeable trails through the planed wood surface. For example, when the plane holding the crowned iron is viewed longitudinally along the sole of the plane, revealing the slightly protruding iron, the effectively crowned edge may appear to have an edge shape that is circular, elliptical, or partially straight with rounded corners. The particular shape of crown is a matter of the woodworker's preference.

A crown is produced in the iron during sharpening after both first honing the iron's back flat and then honing the iron's bevel, typically at a thirty degree (30°) angle. The final step in sharpening the iron so that it is crowned involves stroking the bevel at the intended the intended bevel angle (again, typically 30°) while at the same time slightly varying the downward force applied to the iron laterally from side to side, in order to shift the point of the honing force continuously across the iron's width at the bevel during strokes along the longitudinal axis of both the stone and the iron. As may be evident, this manual operation requires a great deal of effort and skill in order to achieve a crown having the optimal geometry.

The afore-mentioned flattening of an iron's back is similar to the flattening of a chisel back or plane sole. Flattening is required on these tools whether they are new "out-of-the-box" or old, but especially if they are old and neglected. Once flattened, these tools stay flat if used with care. Maintenance of the flats is easier than the initial flattening operation. The flattening stroke is typically reciprocating or back-and-forth over a nominally flat stone with the tool's flat held against the stone.

Due to complex interactions of the human body's mechanics, the applied forces, and the dynamic forces of friction plus accelerations of mass, the stroking tends to introduce some rocking along with pure linear motion. The consequence of this rocking is the creation of some convexity in the tool surface that was intended to be flat. Such convexity may be lessened if considerable skill and technique are applied, but is extremely difficult to minimize, much less eliminate. One such technique is to manually dress the stone used for flattening against another stone or against a large, abrasive surface, such as a concrete sidewalk. By also using reciprocating strokes that similarly induce rocking of the flattening stone, the flattening surface becomes slightly convex. Although crude and imprecise, using such a slightly convex stone for flattening can, with care, reduce unwanted convexity in the iron back or plane sole.

After the iron's back flatness is checked and corrected as necessary, the sharpening activity shifts focus to the bevel. The angle of the bevel relative to the iron's back must be sufficient, given the iron's material strength, for the iron to accommodate the loading of the intended cutting when the iron is installed in the plane. For example, irons to be used to plane hardwoods may require a slightly greater bevel angle than those to be used to plane softwoods. Ultimately, experience should be the guide. Most sharpening starts at about 25° between the general plane of the iron and the sharpening stone or grinding wheel, with the previously mentioned flat back of the iron being held away from the stone or wheel. This initial angle of grind establishes the bevel on the iron.

Whether flat stones or grind wheels under power are employed to form the bevel is also a matter of preference. Using a wheel is faster and leaves a slight concavity in the bevel. Such "hollow" grinds weaken the iron, but also enhance feeling when the bevel is on a flat stone in subsequent steps. Rapidly rotating grinding wheels frictionally heat the iron and induce risk of removing the iron's tempered hardness. Today's diamond stones and certain abrasive stones are sufficiently fast acting that some practitioners do not use powered wheel grinding except for cases of chipped edges requiring extensive stock removal.

The above-mentioned rocking induced during stroking also applies to stroking a bevel on a flat stone. Flatness is desired on bevels because it creates an even cutting edge that achieves the desired result during use. One popular way to avoid convexity from being introduced during manual flattening of the bevel is to use a jig that clamps to the iron or chisel and provides more precise and constant bevel angle control. However, more time is required to set up the clamp and to adjust the bevel angle.

After the bevel is established, the sharpening progresses using successively finer-grained stones and a somewhat larger angle of approximately 30°. Emphasis is on creating a straight edge that is perpendicular to the longitudinal center-line of the iron. Also, the goal is to achieve an edge free of discontinuities, such as sharpening scratches that go through the edge from either the back or bevel side. As the bevel develops, a burr or so-called "wire edge" of very thin metal will form on the back side of the edge. At this stage, the edge may be either crowned and polished or just polished as a straight edge.

Traditionally, the crowning is done by a honing on the bevel with successive strokes, where the downward force applied to the iron against the sharpening stone is progressively off-center somewhat left, then full left, then to somewhat right, then full right, and finally shifted smoothly from one side to the other during a stroke. All the while the honing angle of about 30° is carefully held. With the crown established, bevel polishing is done with strop stokes on very fine waterstones or leather or lap surfaces, such as planed hard wood, medium density fiberboard (MDF), or flattened cast iron, that have been charged (typically with very fine abrasives such as rouge, chrome oxide, or diamond compounds). Strop strokes on the iron's back both wipes away any wire edge and polishes the iron up to the cutting edge.

What is needed is a sharpening means that achieves its desired effect regardless of the bevel angle or crown geometry, both of which optimally may be controlled as desired. Incorporation of diamond abrasive, yet enabling a controlled crowning stroke to be applied to a plane iron, would be particularly advantageous. Additionally, a sharpening apparatus that could be used to flatten the back, bevel, and/or sole of a woodworking tool, such as a plane iron or chisel, with minimal deviation from true flat would be highly desired. Finally, means desired. Finally, means for creating such sharpening apparati would also be desired.

BRIEF SUMMARY OF THE INVENTION

Accordingly, it is an object of the present invention to provide a sharpening apparatus that is capable of crowned sharpening that is efficient and effective regardless of the bevel angle or crown geometry.

It is a further object of the present invention to provide a sharpening apparatus that enables a controlled crowning stroke to be applied to a cutting tool such that the bevel angle can be formed within a narrow range of the desired angle and the geometry formed within a narrow range of the desired dimensions.

It is an additional object of the present invention to provide a sharpening apparatus that comprises diamond abrasives, yet enables the formation of a crown that does not tend to deviate from a continuous curve.

It is a still further object of the present invention to provide means for forming and dressing such sharpening apparati.

The present invention eliminates manual shifting of the push force during the crowning strokes and the associated skill required for producing precisely crowned irons by incorporating a slight longitudinal concavity along the surface of a sharpening apparatus. Where the concavity is further provided with a diamond surface, either directly or by means of disposing a diamond-coated shim within the concavity, the apparatus would retain its intended geometry despite heavy use because the surface shape is stable.

The longitudinal concavity in the sharpening apparatus may have a cross-section of circular, elliptical, or round-flat-round shape, or other suitable shape. Alternatively, the concavity may have a conical shape, with a greater radius at one end and a lesser radius at the other, with the amount of radius varying linearly with distance between ends of the stone. Thus crowning may be done with shorter strokes over the region of the stone's length offering the desired crown.

Optionally, a variation in the amount of crown may be achieved by stroking the iron longitudinally along a cylindrically concave sharpening surface with the iron held at a skewed angle to the stroke direction. Additionally, it is possible to form and sharpen an elliptical crown in this fashion.

Conventional oil stones and water stones may be modified to have a crowning concavity by dressing strokes using a dressing apparatus having a an abrasive surface shape that is the convex cylindrical compliment to the concave shape desired to be imparted to the conventional stone. Use of the modified conventional stone will result in wear and deformation of the cylindrical shape and will require subsequent redressing to return the stone to the desired shape.

The manual reciprocating stroke of any flat surface, such a plane iron back, plane iron bevel, chisel back, chisel bevel, and/or plane sole against a sharpening apparatus, tends to induce some rocking of the flat surface against the sharpening apparatus. This rocking motion results in come convexity in the nominal tool flatness. Historically, this drift from true flat has been approximately countered by manually dressing the sharpening apparatus, typically a quarried or man-made abrasive stone, against other such stones or their their equivalents, such as poured concrete slabs, using similar manual reciprocating strokes. This operation induces a slight convexity in the sharpening stone.

Subsequent sharpening/flattenting of a cutting tool on the now-slightly convex stone tends to compensate for the inevitable rocking of the tool during those operations, yielding much better flatness in the tool edge surface or plane sole. Also, various jigs used for sharpening plane irons and chisels tend to counter the effect of the rocking motion associated with manual reciprocating strokes. However, the optional use of such jigs requires additional set-up time, decreasing their desirability, and is not suitable for use in plane sole flattening.

Concave or convex shaped steel plates may be diamond surfaced by conventional diamond electroplating. Concave or convex shaped plates of any rigid material may be diamond surfaced by a diamond surfaced shim attached to the shaped plate by vacuum chucking or adhesives. Common abrasive papers or films may be held to a shaped plate by vacuum, adhesive, or water surface tension. The diamond surfaces are preferred for durability and performance in honing any level of hard material. Diamond plating is easily accomplished for diamond sizes above about 10 micron. Smaller diamond including the fractional micron sizes may be conveniently put on surfaces of shim or directly on the shaped plate using commercially available diamond compounds, as is done in lapping.

The preferred process for production of shaped plates described above is to bend a uniformly thick steel plate, within its elastic range, against a mandrel having a shape that is complimentary to the desired convex or concave final plate and to precision grind a flat surface on the bent plate. Because the forces applied to the plate when bending it against the the mandrel did not exceed the plate's elastic limit, the plate will return to its original, unbent condition when it is released from the mandrel. In this way, a curvature is imparted to the ground side of the plate that is the complimentary opposite of the mandrel's convex or concave curvature.

It may readily be understood that the plate's thickness must be greater than the depth of the concavity or convexity to be created in the plate's surface. Also, the plate should not be thicker than necessary for structural integrity, so as to minimize the forces necessary to achieve the desired bending against the mandrel. It is contemplated that plates may range in thickness from about 0.03" to about 0.5", and preferably between about 0.125" to about 0.25".

Although the mandrel must be precision manufactured, its cost will be offset by relatively easy volume production of the shaped plates. It is contemplated that the plates may be held against the mandrel by magnetic chucking, vacuum chucking, or by mechanical means. In the case of the convex mandrel, the plate holding may also employ tension pull on the plate parallel to the plate near its edges. The ground plates may have some undesired residual warp when released from the mandrel due to the relief of internal stresses in the plate by the grinding process. Such warp may be corrected in use by vacuum clamping the flat, non-ground side of the plate against a flat surface plate, such as a lapping stone. The previously described diamond abrasive surfacing of the curved side of the plate by vacuum clamping of diamond shim may be combined with this warp correction technique.

The shaping of metal plates may be done also by CNC milling, CNC grinding, or electrical discharge machining of thick metal plates.

The present invention enables the use of a slightly convexly or concavely curved abrasive surface, for use as described above for woodworking tools or in other fields requiring such processing of precision parts or tools. The present invention may further employ either cylindrical or conic abrasive surfaces. Cylindrical abrasive surfaces are desirable when a curvature of a fixed radius is desired, or where accuracy of the curvature radius is required. The suitable curvature typically desired has a radius in the range of 150 to 600 inches for crowns in the range of 0.006 to 0.001 inch, although any desired curvature may be achieved by means of the present invention.

Conic or semi-conic surfaces may be used to enable a user, by means of short sharpening strokes, to achieve an approximate desired curvature among a range of possible curvatures provided along the length of the abrasive surface as the curvature radius progressively declines. In this way, one abrasive surface may be used to achieve a variety of curvatures.

Numerous other objects, features, and advantages of the present invention will become readily apparent from the following detailed description of the invention taken in conjunction with the claims, and from the accompanying drawings in which like numerals are employed to designate like parts throughout the same.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1A:
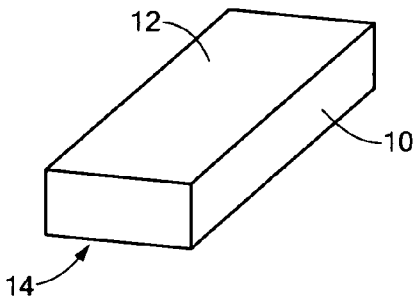
FIG. 1A shows a perspective view of a conventional, flat sharpening stone.
Figure 1B:
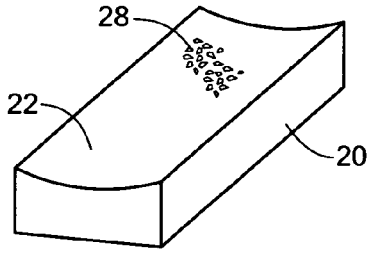
FIG. 1B shows a perspective view of a first variation of the first embodiment of the present invention, wherein the upper sharpening surface is cylindrically concave.

While the sharpening apparatus of the present invention is susceptible of embodiment embodiment in many different forms, there is shown in the drawings and will be described herein in detail, a preferred embodiment of the invention. It should be understood however, that the present disclosure is to be considered an exemplification of the principles of the invention and is not intended to limit the spirit and scope of the invention and/or claims of the embodiments illustrated.

In its simplest form, as shown in FIG. 1A, a conventional sharpening apparatus has a base 10 and a flat upper sharpening surface 12. It is understood for the purposes of the following description that the lower surface 14 of base 10 may also be used for sharpening and may be manufactured such that it is functionally different from upper sharpening surface 12, e.g., where it presents a coarser or finer grain than upper surface 12.

As shown in FIGS. 1B-2D, the sharpening apparatus of the present invention comprises a conventional sharpening apparatus base 20, further provided with an upper sharpening surface 22-22''' having disposed therewithin a concavity of various desirable configurations. In a first variation of this embodiment, shown in FIGS. 1B and 2A, upper sharpening surface 22 defines a cylindrical single curvature of a desired radius r.

Figure 2A:
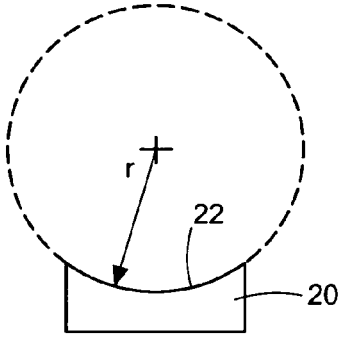
FIG. 2A shows an end view of the embodiment of FIG. 1B.
Figure 2B:
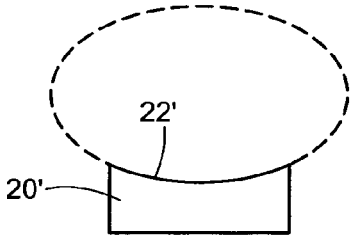
FIG. 2B shows an end view of a second variation of the first embodiment of the present invention, wherein the upper sharpening surface is elliptically concave.
Figure 2C:
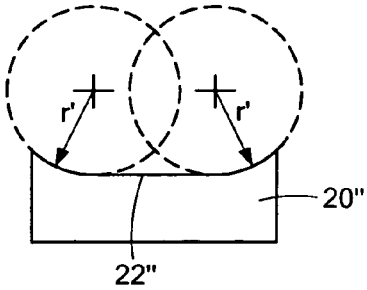
FIG. 2C shows an end view of a third variation of the first embodiment of the present invention, wherein the upper sharpening surface has a round-flat-round concavity.
Figure 2D:
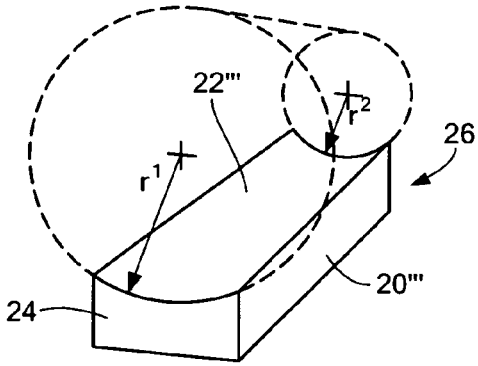
FIG. 2D shows a perspective view of a fourth variation of the first embodiment of the present invention, wherein the upper sharpening surface is conically concave.

In a second variation of this embodiment, shown in FIG. 2B, upper sharpening surface 22' defines an elliptical single curvature. In a third variation of this embodiment, shown in FIG. 2C, upper sharpening surface 22" defines a round-flat-round single curvature, wherein the curved portions are defined by circles having a desired radius r'. In a fourth variation of this embodiment, shown in FIG. 2D, upper sharpening surface 22''' defines a conical curvature, wherein upper sharpening surface 22''' defines at first end 24 a circular curvature of a desired radius $r^1$, with upper sharpening surface 22''' tapering conically, with the amount of conically, with the amount of radius varying linearly with distance, until upper sharpening surface 22''' defines at second end 26 a circular curvature of a desired radius $r^2$.

Figure 3A:
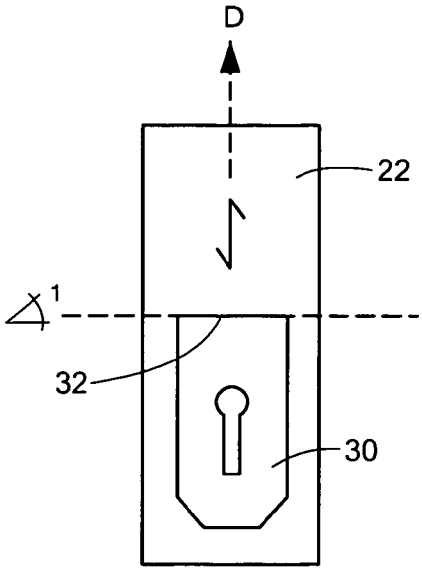
FIG. 3A shows a plan view of a first iron sharpening process using the sharpening apparatus of the present invention.
Figure 3B:
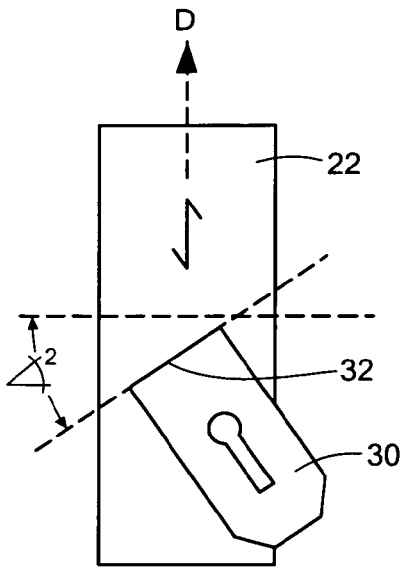
FIG. 3B shows a plan view of a second iron sharpening process using the sharpening apparatus of the present invention.
Figure 4:
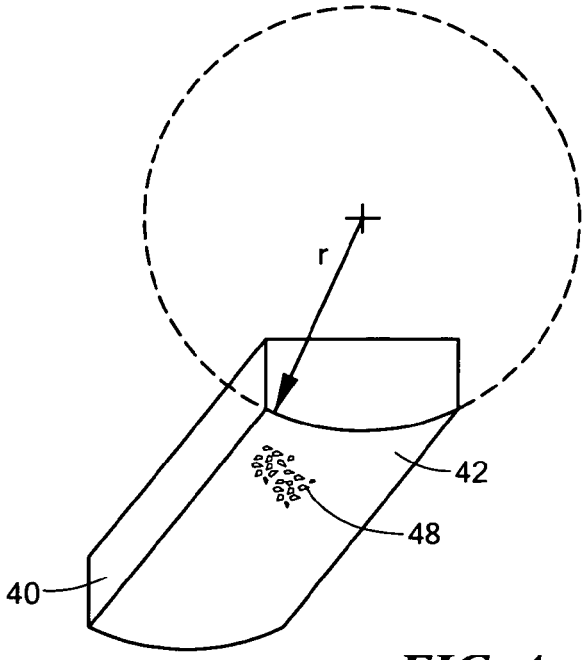
FIG. 4 shows a perspective view of a first embodiment of a dresser constructed in accordance with the principles of the present invention.

FIG. 3A shows a first method of producing precisely crowned irons using the first variation of the first embodiment of the present invention. Iron 30 is stroked longitudinally against upper sharpening surface 22 along line D, with cutting edge 32 held at angle 1, approximately 90° from line D. Optionally, a variation in the amount of crown may be achieved by stroking iron 30 longitudinally against upper sharpening surface 22 along line D, with cutting edge 32 held at the desired angle 2, which is greater than 90° from line D. Additionally, it is possible to form and sharpen an elliptical crown in this fashion.

Conventional oil stones and water stones may be modified to have a crowning concavity by dressing strokes using dressing apparatus 40 having a dressing surface 42 constructed so that it is the convex compliment to the concave shape desired to be imparted to the conventional stone. Dressing apparatus 40 is further useful to redress sharpening apparati of the present invention that have undergone wear and deformation of the cylindrical shape after some period of use. Such subsequent redressing will return upper sharpening surface 22 to the desired shape.

Concave- or convex-shaped steel sharpening apparati formed in accordance with the principles of the present invention may have their sharpening surfaces provided with abrasive diamond by conventional diamond electroplating. Concave- or convex-shaped plates of any rigid material may be provided with a diamond sharpening surface by retaining a diamond surfaced shim against the shaped plate by means of vacuum chucking or adhesives 101, FIG. 6. Common abrasive papers or films likewise may be held to a shaped plate by vacuum, adhesive, or vacuum, adhesive, or water surface tension.

Figure 5A:
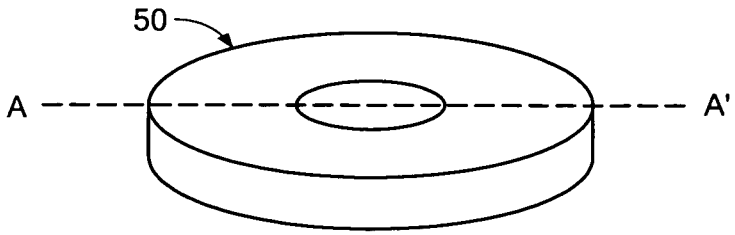
FIG. 5A shows a perspective view of a second embodiment of the present invention.
Figure 5B:
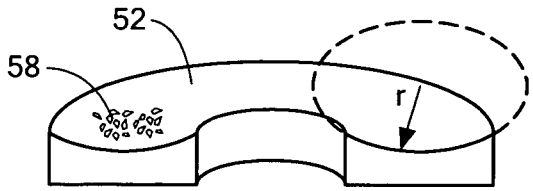
FIG. 5B shows a cross-sectional view of the embodiment of FIG. 5A taken through the line A-A'.
Figure 6:
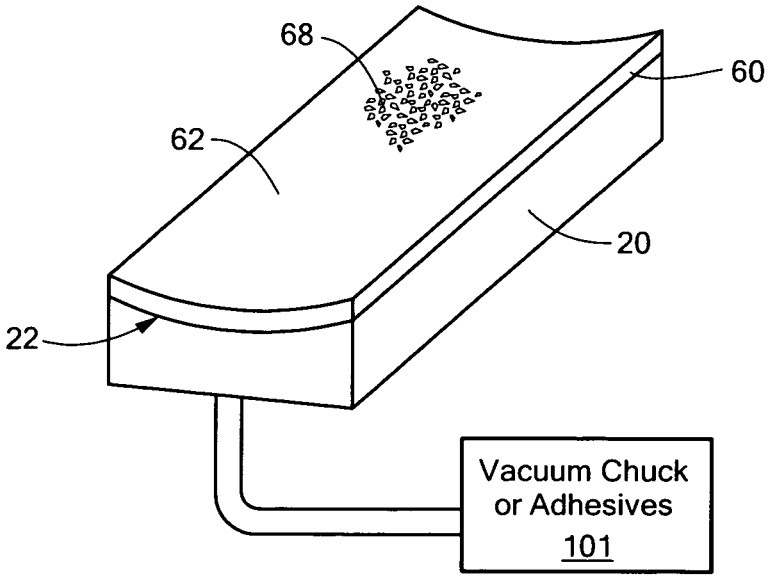
FIG. 6 shows an end view of a third embodiment of the present invention.

Thus, the sharpening apparatus of the present invention would retain its intended geometry despite heavy use where upper sharpening surface 22 is further provided with a diamond surface 28, either directly or, if using an abrasive shim, as shown in FIG. 6, where abrasive 68 disposed on upper surface 62 of shim 60 is diamond. This is because the surface shape is stable due to the wear resistance of diamond. In a second embodiment, shown in FIGS. 5A and 5B, a ring-shaped base 50 may be used when upper sharpening surface 52 defines a continuous annular shape defined in cross-section as circular, elliptical, or round-flat-round. This embodiment is particularly suitable for use in connection with a driving apparatus, such as a turntable or grinding wheel, when a large number of irons need to be formed and maintained. Upper sharpening surface 52 may also be provided with diamond abrasive 58 by conventional means.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

The invention claimed is:

1. A method for sharpening a hand plane iron, the method comprising:

providing a base shaped to define a sharpening surface including a precise concave cylindrical curvature having a large radius in the range of about 150 inches to about 600 inches; and forming a precise predetermined amount of crown in the cutting edge of the hand plane iron when a bevel of the hand plane iron is stroked against the sharpening surface with the cutting edge proximately perpendicular to the cylindrical axis of the cylindrical curvature.

2. The method of claim 1 further including the step of CNC grinding the base to form the precise concave cylindrical curvature.

3. The method of claim 1 further including the step of CNC milling the base to form the precise concave cylindrical curvature.

4. The method of claim 1 further including the step of electrical discharge machining of the base to form the precise concave cylindrical curvature.

5. The method of claim 1 further including the step of providing a durable and abrasive diamond material on the sharpening surface.

6. The method of claim 5 further including the step forming the precise predetermined amount of crown in the cutting edge of the hand plane iron when a bevel of the hand plane iron is stroked against abrasive diamond material of the sharpening surface with the cutting edge proximately perpendicular to the cylindrical axis of the cylindrical curvature.

7. The method of claim 5 in which the abrasive material is disposed on the sharpening surface by embedment and/or bonding.

8. The method of claim 1 further including the step of coupling a conforming shim to the cylindrical curvature.

9. The method of claim 7 further including the step of adding an abrasive diamond material to the shim.

10. The method of claim 1 further including the step providing a conical shaped cylindrical curvature.

11. A method for creating concave cylindrical curvature for sharpening a hand plane iron in an ordinary stone and/or water stone, the method including:

providing a dressing plate including a convex dressing surface complement to a concave cylindrical curvature having a large radius of about 150 inches to about 600 inches; and forming a concave cylindrical curvature having a large radius of about 150 inches to about 600 inches in an ordinary stone and/or water stone by stroking the dressing plate against the ordinary stone and/or water stone.

* * * * *